US005950824A

United States Patent [19]

Millar, Jr.

[11] Patent Number: 5,950,824

[45] Date of Patent: Sep. 14, 1999

[54] TAPERED GOLF BAG

[76] Inventor: John Millar, Jr., 5151 North A1A, #212, Indian River Shores, Fla. 32963

[21] Appl. No.: 09/064,044

[22] Filed: Apr. 21, 1998

[51] Int. Cl.[6] ..... A63B 55/00; A63B 55/02

[52] U.S. Cl. ..... 206/315.5; 206/315.3; 206/315.7

[58] Field of Search ..... 206/315.2–315.3

[56] References Cited

U.S. PATENT DOCUMENTS

| | | | |
|---|---|---|---|
| 1,672,549 | 6/1928 | Thompson | 206/315.6 |
| 2,185,706 | 1/1940 | Gihon, 3D | 206/315.3 |
| 2,422,218 | 6/1947 | Bauer | 206/315.8 X |
| 2,551,780 | 5/1951 | Wood | 206/315.3 |
| 3,941,398 | 3/1976 | Nelson | 206/315.6 X |
| 4,319,616 | 3/1982 | Light | 206/315.6 X |

FOREIGN PATENT DOCUMENTS

| | | | |
|---|---|---|---|
| 6415 | of 1913 | United Kingdom | 206/315.7 |
| 150578 | 9/1920 | United Kingdom | 206/315.2 |
| 607399 | 8/1948 | United Kingdom | 206/315.2 |

*Primary Examiner*—Sue A. Weaver
*Attorney, Agent, or Firm*—Michael K. Gray

[57] ABSTRACT

A tapered golf bag having a base which has a greater cross-sectional area than the cross sectional area of the opening of the golf bag provides easy insertion and removal of clubs and more stability to the bag when it rests in an upright position. Storage compartments are provided which lie between a contiguous side which defines a club receptacle cavity and normal boundary lines extending perpendicularly upward from the periphery of the base.

10 Claims, 2 Drawing Sheets

TAPERED GOLF BAG

FIELD OF THE INVENTION

The present invention generally relates to golf bags. More particularly, the present invention pertains to a tapered golf bag which is designed so that the cross-sectional area of the bag increases from the top (i.e., opening) of the bag to the base or bottom of the bag.

BACKGROUND OF THE INVENTION

Traditionally, the club receptacle cavity of a golf bag has been straight up and down from top (opening) to the bottom base of the bag, with the base and opening being of the same shape and area. The top of the bag typically has a circular, horizontal opening, which opening, when the bag is in an upright position, is parallel to the ground. Variations of the circular opening include square, oval and triangular designs.

However regardless of the shape of the opening, in the traditional golf bag, the sides of the club receptacle cavity are perpendicular to the base of the bag. In other words, the body of the bag (i.e., the sides which form the receptacle cavity for the golf clubs) are arranged straight up and down from the top of the bag to the base.

In the prior art, many golf bags are provided with pockets or compartments sewn into the side of the bag to enable a golfer to store golf balls, towels, clothing and other accessories the golfer might wish to access on the golf course.

In that the receptacle cavity for the golf clubs is defined by sides which are straight up and down from the base of the golf bag to the opening of the golf bag, when pockets or compartments are added to the bag, the golf bag takes on a somewhat lopsided appearance. This is due to the fact that the pockets and compartments extend horizontally away from a normal line (i.e., perpendicular lines) to the periphery of the base of the golf bag. (In actuality, instead of the word "sides" being used, the receptacle cavity is formed of a contiguous side extending 360 degrees around the base of the golf bag).

Even when placing the golf bag on a flat surface in an upright position, the traditional bag, particularly when provided with pockets and compartments, has a propensity to tip over. All too often when a golf bag containing clubs is removed from a closet or storage area and placed in an upright position, the golf bag soon crashes to the floor.

This scenario is often repeated when a golf bag is removed from the trunk of a car and placed upright on the surface of a parking lot. The typical golf bag is prone to fall over when the surface is less than level or the slightest lateral force is applied to it. This propensity to fall over is caused by the fact that the typical golf bag is top heavy.

Such inadvertent falling is not only bad for the bags (in that the bags are scratched and scuffed by such occurrences), but such falls often damage the clubs the bags contain.

Another problem with traditional bags is that they are not designed to accept the fact that the shaft of the golf club increases in diameter from the point (i.e., the hosel) where the shaft connects to the club head to the grip of the shaft at the butt end of the club.

In other words, the grip-end (butt) of a club takes up more space than the narrow part of the shaft attached to the club head.

In that the grip end (butt) of the club rests upon the bottom of the golf bag at the base of the bag, this region of the golf bag (in a bag full of clubs) is congested to an extent that the various grips of different clubs are in frictional contact with one another—often necessitating muscular effort on the part of the golfer when removing or replacing a club.

Thus, a need is seen for a golf bag which is constructed to easily accommodate a full set of clubs so that the grips of the various clubs are not in frictional contact at the bottom of the bag, and whose base provides stability when the bag is in an upright position—even when the bag is provided with pockets and compartments.

SUMMARY OF THE INVENTION

Accordingly, one object of the present invention is to provide a golf bag which can accommodate a full set of golf clubs such that the grips of the club are not in frictional contact with one another.

Another object of the present invention is to provide a golf bag whose base provides stability to the bag such that the bag is not prone to fall over when exposed to a minimal lateral force.

Still another object of the present invention is to provide a golf bag which is provided with storage compartments and pockets while maintaining a fashionable balanced appearance.

Yet another object of the present invention is to provide a golf bag having a lower center of gravity.

These and other valuable objects and advantageous of the present invention are provided by a golf bag having a base. A contiguous side is connected to a periphery of the base. The contiguous side slopes upwards from, the base so as to define receptacle cavity. The contiguous side forms a top peripheral edge which encloses a cross sectional area less than a cross-sectional area enclosed by the periphery of the base. A storage compartment region is connected to the contiguous side. The storage compartment region is defined by normal lines extending from the periphery of the base and by the contiguous side. The storage compartment region is comprised of a plurality of storage compartments whose cross-sectional area increases as the contiguous side slopes upwards toward the top peripheral edge and decreases as the contiguous side slopes downwards toward the periphery of the base.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

When referring to the drawings, it should be understood that reference numerals designate identical or corresponding parts throughout the respective figures.

THE DETAILED DESCRIPTION OF THE INVENTION

Figure 1:
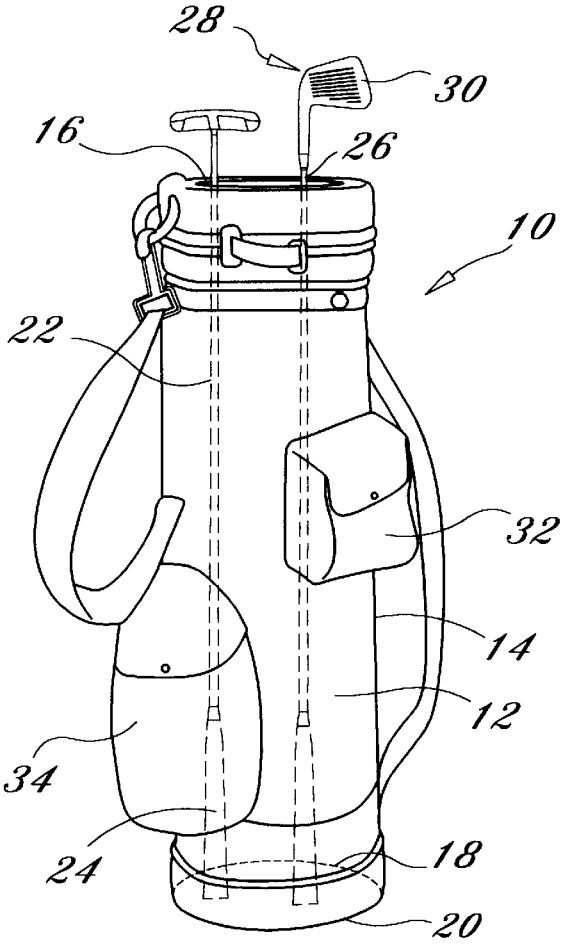
Fig. 1 Prior Art
FIG. 1 is a see-through illustration of a prior art golf bag.

With reference to FIG. 1, the prior art bag 10 is provided with a club receptacle cavity 12 which is formed by contiguous side 14 and base 20. The contiguous side 14 connects to the periphery 18 of base 20 extending vertically upward from the periphery 18 of the base. At the top of the bag, the top peripheral edge 16 of the contiguous side 14 forms an opening for the receptacle cavity 14. The club receptacle cavity 14 is formed in the shape of a right circular cylinder by base 18 and contiguous side 14.

The club receptacle cavity 14 can be formed of molded plastic and can be provided with a protective cover of nylon, duck canvas, rayon or the like. In more expensive bags, the club receptacle cavity is formed by padded leather sewn to the specified shape.

Still with reference to FIG. 1, a ball storage compartment 32 and a general storage compartment 34 are connected to the contiguous side 14 of the golf bag 10. The ball storage compartment 32 and general storage compartment 34 not only give the golf bag 10 an uneven appearance—they contribute to the instability of the golf bag. That is, the ball storage compartment 32 and general storage compartment 34 are contributing factors to the vertical instability of the golf bag 10 such that the golf bag 10 is prone to tip over from an upright position upon the introduction of a small lateral force.

In FIG. 1, golf clubs 28 are inserted inside the club receptacle cavity 12 with the heads 30 of the clubs 28 extending above the top peripheral edge 16 of contiguous side 14. Each club 28 is provided with a shaft 22 with the narrowest part of the shaft 26 being located near the head 30 of each respective club 28. The shaft 22 of the golf club 28 becomes wider in diameter at the grip region 24 of the club 28. Thus, more space is needed at the bottom of the golf bag to easily insert, remove or accommodate the grips of the golf clubs.

Figure 2:
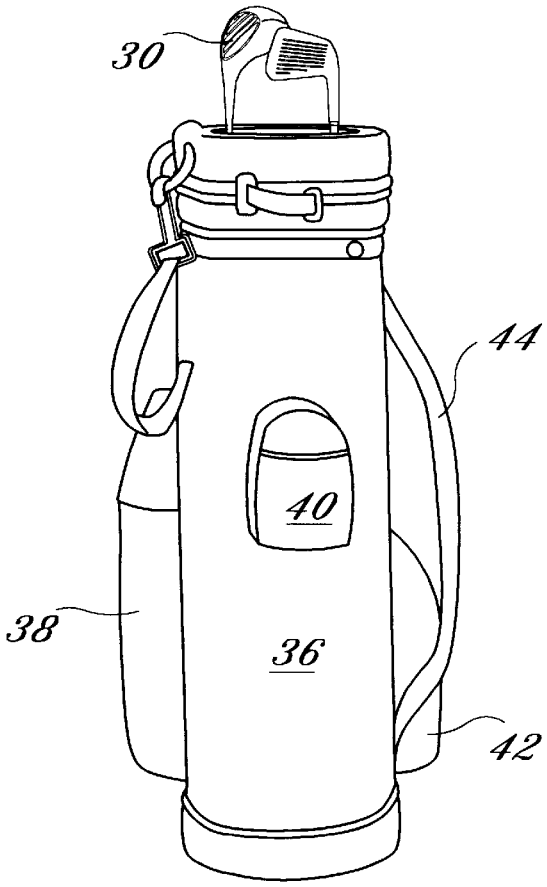
Fig. 2 Prior Art
FIG. 2 is a perspective illustration of a prior art golf bag.

In FIG. 2, a prior art golf bag 36 has a clothing compartment 38 attached to the side of the bag. Also, a ball storage compartment 40 and shoe storage compartment 42 are provided on the side of the golf bag.

A strap 44 (FIG. 2) is provided for purposes of carrying the golf bag 36. Each of the storage devices, i.e., ball storage compartment 40, shoe storage compartment 42, and clothing compartment 38 contribute to the uneven look of the bag. Further in that the compartments are situated at considerable lateral lengths away from what would be considered the center vertical axis of the golf bag, these compartments 38, 40 and 42 contribute to the vertical instability of bag 36—particularly contributing to such instability when the compartments are packed with golfing accessories and clothing.

Figure 3:
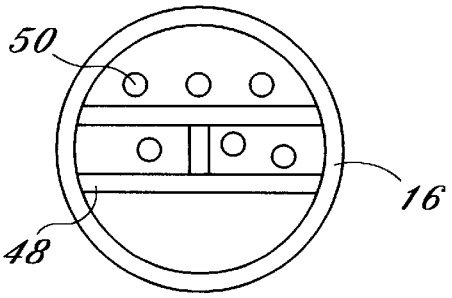
Fig. 3 Prior Art
FIG. 3 is a top view of a prior art compartment divider for positioning golf clubs in various compartments within a golf bag.

In FIG. 3, a top view of a prior art golf bag demonstrates a club compartment divider 48 which allows various irons and woods (not shown) to be inserted into various compartmentalized areas of the golf bag.

However, such compartment dividers do not increase the area at the bottom or base of the bag and in fact can augment the frictional contact between clubs.

Still with reference to FIG. 3, golf club tubes 50 are positioned within the compartment divider. These tubes are typically made of plastic and are for the purpose of providing a guide path for the insertion of a golf club. Since the tubes are wide enough in diameter to accommodate the wide grip region of a golf club, significant space is taken up by such tubes, requiring an exaggerated size bag if a full set of clubs are desired. (Fourteen clubs are allowed under U.S.G.A. rules.)

Figure 4:
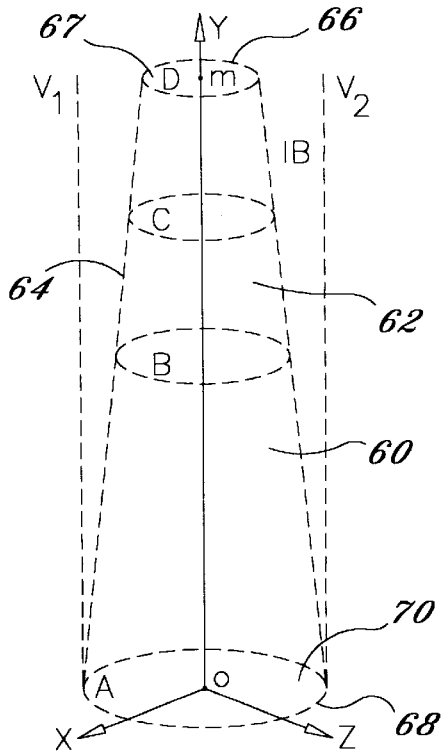
FIG. 4 is a schematic illustration depicting the golf bag of the present invention as it is aligned on an XYZ coordinate system such that the area of a horizontal section of the club receptacle cavity of the bag decreases as one goes up the Y axis from the bottom of the bag to the top of the bag.

In the schematic illustration of FIG. 4, the club receptacle cavity 62 of the golf bag 60 according to the present invention, has a contiguous side 64 and circular base 70. The contiguous side 64 connects to the periphery 68 of base 70. The contiguous side connects around the 360 degree periphery of base 70 and slopes upward to form a top peripheral edge 66 which forms an opening 67 for the club receptacle cavity 62, so as to form a club storage region.

The base 70 has a horizontal cross-sectional area A. The horizontal cross sectional area in the club receptacle cavity 62 decreases as one goes from the base to the top of the club receptacle cavity. Thus with reference to FIG. 4, the cross-sectional area of section B is less than section A, the cross sectional area of section C is less than B, and the cross sectional area A at the top of the golf bag has the smallest cross sectional area.

An X axis, a Y axis and a Z axis serve to give perspective of the three dimensional arrangement of the club receptacle cavity 62. Point o represents the center of the circular base 70. The Y axis is normal to and extends upward from point o. The X axis represents the width component direction, and the Z axis represents the breadth component direction. The coordinates at point o would be zero for the X, Y and Z axis, (0,0,0).

Still with reference to FIG. 4, vertical lines $V_1$ and $V_2$ are normal to the periphery 68 of the base 70 and are used to indicate that utilizable space exists between the vertical normal lines, e.g., $V_1$ and $V_2$, which extend vertically upward around the periphery 68 of base 70, and the contiguous side 64 of club receptacle cavity 62. This in between space is indicated as space IB.

Point o (FIG. 4) represents the center of the cross sectional area A, and point m represents the center of the cross sectional area of D. The same vertical axis (i.e., the Y axis) intersects points o and m. Contiguous side 64 being uniformly symmetrical in relation to the vertical Y axis.

Figure 5:
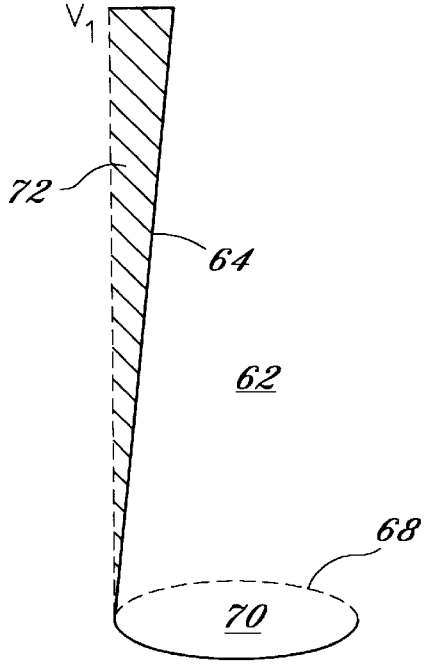
FIG. 5 is a schematic illustration which demonstrates that the pocket or storage compartment areas of the golf bag of the present invention are positioned closer to the vertical axis normal to the center of the base than are the peripheral edges of the base of the golf bag.

With reference to FIG. 5, a storage compartment region 72, corresponding to space IB of FIG. 4, exists between normal line $V_1$ and the contiguous side 64 of the club receptacle cavity 62. This storage compartment region 72 can be utilized for purposes of creating storage compartments for the golf bag 60 of the present invention.

Figure 6:
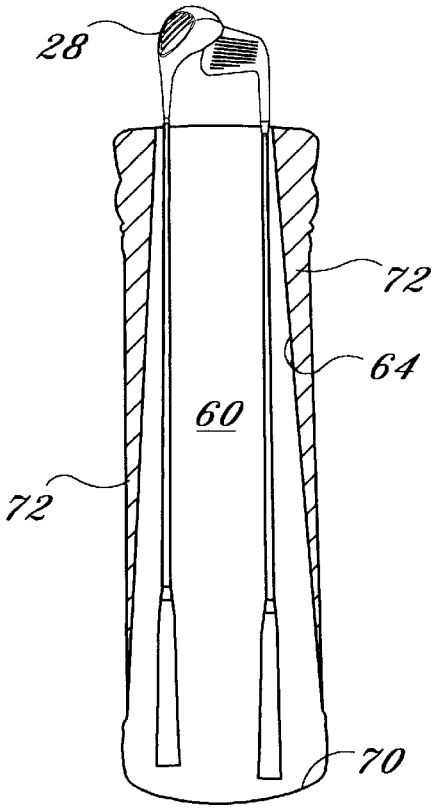
FIG. 6 is a see-through side view of the golf bag according to the present invention.

In FIG. 6, storage compartments are provided which are connected to the contiguous side of the golf bag. The base 70 has a diameter greater than the opening 67 formed by top periphery 66 of the contiguous side 64 of golf bag 60. This results in the cross-sectional area at the base 70 being greater than the cross sectional area at the opening 67 of golf bag 60.

For example, if the diameter of the top opening 67 of the golf bag is 8 inches, the cross sectional area would be 3.1416×16 inches=50.27 square inches ($\pi r^2$=Area). If the diameter of the circular base 70 were 10 inches, the area would be 3.1416×25 inches=78.54 square inches. Thus, in such an instance, a cross sectional area increase of approximately 56% is realized from the top to the bottom base of the golf bag.

A 56% increase in the surface area of the horizontal cross-sectional area of base 70 (area A of FIG. 4) of golf bag 60 as compared to the cross sectional area of the top of the golf bag (area D of FIG. 4) is within a suggested increased range (a 50% to 60% area increase) from the bottom of the bag to the top of the bag.

If bags are provided with a tapered opening, for purposes of calculating the percent difference between the top and bottom of the bag (i.e., cross-sectional area difference), such a calculation should be taken by extending the tapered part of the bag opening to the top most part of the bag so that a horizontal cross section at the top can be taken.

In that the height of a golf bag ranges around 35 inches, much space is available in the golf bag of the present invention to accommodate storage regions without laterally extending these storage regions beyond the periphery of the base.

If in FIG. 4, the golf bag had an opening 67 at the top with a diameter of eight inches and a base 70 with a diameter of ten inches, from the base 70 to the peripheral edge 66 at the top of the bag, the contiguous side 64 at each point on the base periphery 68 would slope upward 35 inches (in a bag thirty-five inches tall) for every lateral inch inward. If the diameter of the opening 67 at the top were 9 inches and the base 70 had a diameter of 13 inches, the contiguous side 64, at each point on the base periphery 68, would slope upward (in a bag 35 inches tall) 35 inches for every two inches inward.

Figure 7:
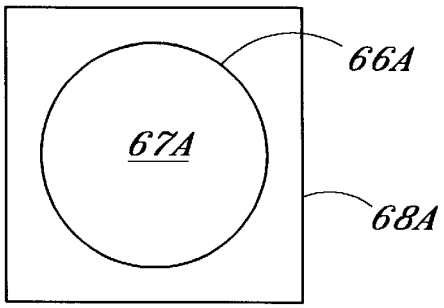
FIG. 7 is a top view of an alternative embodiment of the present invention in which the opening of the golf bag is round and the base of the bag is square in shape.

In FIG. 7, a top view demonstrates a golf bag having a circular top opening 67A formed by top peripheral edge 66A and a square base 68A. This demonstrates that the teachings of the present invention can be utilized for openings and bases of various geometric shapes.

However, regardless of the geometric shapes used, the base should have a greater cross-sectional area than the top opening of the bag.

Figure 8:
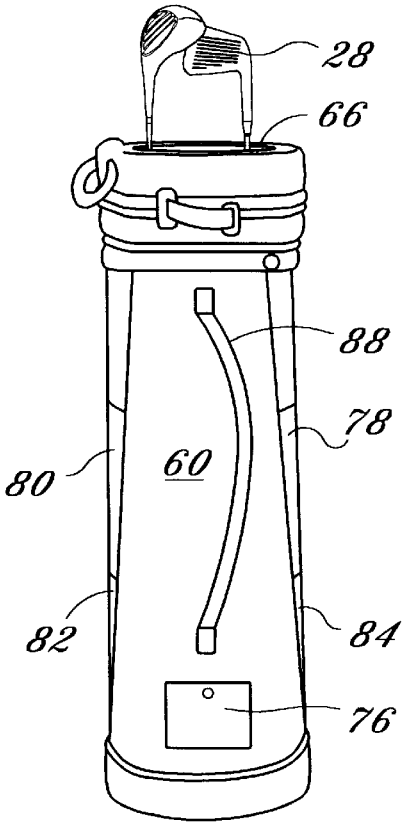
FIG. 8 is a perspective view of the golf bag of the present invention which maintains a tailored up and down appearance even when provided with pockets and compartments.

In FIG. 8, the golf bag of the present invention is provided with a plurality of storage compartments 76, 78, 80, 82, 84 which are positioned within the storage compartment region 72 (FIG.6).

Thus, for example, storage compartment 76 can be used to store golf balls, storage compartment 80, 82 can be used to store clothing; and storage compartments 78 and 84 can be used to store clothing and other golf accessories. A strap 88 is provided for purposes of aiding the carrying of the golf bag.

The teachings of the present invention allow for a greater area at the bottom of a golf bag to accommodate golf clubs such that the ease of removal and replacement of the clubs is enhanced and contact between the club shafts is minimized. Further, the construction of the golf bag of the present invention allows for storage compartments to be positioned on the bag such that the bag has a stylish appearance and is well balanced.

The extra area at the base of the golf bag prevents the bag from falling over when exposed to small lateral forces. The base 70 of the bag can be weighted with metal or other suitably dense material to provide further stability to the golf bag when it is in the upright position.

In that the golf bag of the present invention has a lower center of gravity (i.e., the center of gravity being farther away from the top of the bag than in the traditional golf bag), more stability is created even when the bag is picked up from a prostrate position on the ground. Often in a traditional bag, when the bag is picked up from a prostrate position on the ground, the golf clubs inside the bag are prone to fall out due to a fulcrum effect which occurs upon lifting the bag.

The foregoing description is intended to be illustrative and non-limiting. Additional modifications and variations are possible in light of the above teachings. It is therefore understood the invention may be practiced otherwise than is specifically described herein, and still be within the scope of the appended claims.

What is claimed is:

1. A golf bag comprising:

a base;

a contiguous side connected to a periphery of said base, said contiguous side sloping upward from said base so as to define a receptacle cavity, said contiguous side forming a top peripheral edge which encloses a cross sectional area less than a cross-sectional area enclosed by the periphery of said base;

a storage compartment region connected to said contiguous side, said storage compartment region being defined by normal lines extending from the periphery of said base and said contiguous side; and wherein said storage compartment region is comprised of a plurality of storage compartments whose cross-sectional storage area increases as said contiguous side slopes upwards toward said top peripheral edge and decreases as said contiguous side slopes downwards toward said periphery of said base.

2. A golf bag according to claim 1, wherein:

said contiguous side is uniformly symmetrical in relation to a vertical axis which intersects a center point (o) on said base.

3. A golf bag according to claim 1, wherein:

said base is comprised of a dense, weighty material.

4. A golf bag according to claim 1, wherein a cross sectional area (D) at said top peripheral edge is at least 50 square inches.

5. A golf bag according to claim 4, wherein a said cross sectional area (A) of said base is more than 50% greater than said cross sectional are (D) of said top peripheral edge.

6. A golf bag according to claim 5, wherein:

said cross-sectional area (D) of said top peripheral edge has a center point (m), said point (m) and a center point (o) on the base being intersected by a vertical axis.

7. A golf bag according to claim 6, wherein:

said periphery of said base forms a circle.

8. A golf bag according to claim 6, wherein:

said top peripheral edge forms a circle.

9. A golf bag according to claim 6, wherein:

said periphery of said base forms a square.

10. A golf bag comprising:

a base;

a contiguous side connected to a periphery of said base, said contiguous side sloping upward from said base so as to define a receptacle cavity, said contiguous side forming a top peripheral edge which encloses a cross sectional area less than a cross-sectional area enclosed by the periphery of said base;

a storage compartment region connected to said contiguous side, and wherein said storage compartment region is comprised of a plurality of storage compartments whose cross-sectional storage area increases as said contiguous side slopes upwards toward said top peripheral edge and decreases as said contiguous side slopes downwards toward said periphery of said base.

* * * * *